US006048012A

United States Patent [19]

Selby et al.

[11] Patent Number: 6,048,012

[45] Date of Patent: Apr. 11, 2000

[54] UNDERSTRUCTURE LIFTING BEAM

[76] Inventors: Cloyd R. Selby, 13700 Parker Rd., Lockport, Ill. 60441; William H. Setzke, 25616 Governors Hwy., Monee, Ill. 60449

[21] Appl. No.: 08/873,687

[22] Filed: Jun. 12, 1997

[51] Int. Cl.[7] ..... B66C 1/10

[52] U.S. Cl. ..... 294/81.3; 294/81.56; 294/67.5

[58] Field of Search ..... 294/81.1, 81.3, 294/81.4, 81.56, 67.1, 67.2, 67.21, 67.32, 67.5; 414/10; 212/195–198

[56] References Cited

U.S. PATENT DOCUMENTS

| | | | |
|---|---|---|---|
| 2,246,142 | 6/1941 | Moore | 294/67.21 |
| 3,451,224 | 6/1969 | Colechia et al. . | |
| 3,552,793 | 1/1971 | Lehtonen . | |
| 3,572,803 | 3/1971 | Pompe | 294/81.3 |
| 3,675,961 | 7/1972 | Wheeler . | |
| 3,762,755 | 10/1973 | Saether | 294/81.3 |
| 4,017,109 | 4/1977 | Belinsky . | |
| 4,245,941 | 1/1981 | Charonnat . | |
| 4,251,098 | 2/1981 | Belinsky . | |
| 4,355,832 | 10/1982 | Anderson . | |
| 4,418,953 | 12/1983 | Dunbar . | |
| 4,451,198 | 5/1984 | Sanderson . | |
| 4,626,012 | 12/1986 | Weldele . | |
| 4,671,721 | 6/1987 | Pratt et al. . | |
| 4,759,674 | 7/1988 | Schroder et al. . | |
| 5,312,218 | 5/1994 | Pratt et al. | 294/81.3 |

FOREIGN PATENT DOCUMENTS

| | | | |
|---|---|---|---|
| 266-339 | 3/1989 | Germany | 294/67.1 |
| 969-638 | 11/1982 | U.S.S.R. | 294/67.5 |
| 992-383 | 2/1983 | U.S.S.R. | 294/67.5 |
| 1512-908 | 10/1989 | U.S.S.R. | 294/67.5 |

*Primary Examiner*—Dean Kramer
*Attorney, Agent, or Firm*—Lee, Mann, Smith, McWilliams, Sweeney & Ohlson

[57] ABSTRACT

A self-leveling lifting beam adapted to be connected to the boom of crane to assist in the transport of a load to a high-rise building construction. The apparatus itself, which is fabricated of heavy gage steel and fully encased so there are no exposed working parts susceptible to damage or to injury to employees, is designed for the abusive and demanding construction industry. The lifting beam works on the principle of an internal counterweight that is adapted to be hydraulically adjusted, and the use of electric limit switches to automatically maintain horizontal equilibrium even if an unforeseen load shift occurs in mid-air. Through the use of storage batteries fully encased in the apparatus, there is no need for an attached electrical source. As the lifting beam is held by the crane cable and a swivel, the beam can be moved in all three dimensions.

18 Claims, 3 Drawing Sheets

UNDERSTRUCTURE LIFTING BEAM

BACKGROUND OF THE INVENTION

This invention is designed to provide an apparatus to be used primarily in conjunction with a crane in situations requiring a load, be it materials, equipment or otherwise, to be inserted into a portal or under an obstruction by the use of an elongated boom. In today's construction of high-rise buildings, there is often a need to place materials in a particular location without the aid of an attached loading platform. This necessitates the use of hooks and ropes to position the load and manually pull it through an opening, usually a vacant window opening. This function can be dangerous to both the employees and to the load, especially when the task is at great heights.

SUMMARY OF THE INVENTION

The present invention is designed for the abusive and demanding construction industry, being fabricated of heavy gage steel and fully encased so there are no exposed working parts susceptible to damage or to causing injury to employees. The lifting beam works on the principle of an internal counterweight that is adapted to be hydraulically adjusted, and the use of electric limit switches to automatically maintain the beam in a horizontal position even if an unforeseen load shift occurs in mid-air. Through the use of storage batteries fully encased in the apparatus, there is no need for an attached electrical source. As the lifting beam is held by the crane cable and a swivel, the beam can be moved in all three dimensions.

The preferred embodiment of the invention includes a lifting beam which is sixteen feet in length and twenty-two feet when fully extended. The embodiment described herein is designed for two tons of load with an insertion distance of eight to nine feet when utilizing the center lifting eyelet. The invention described herein can be applied to a lifting beam for any particular weight or shape, using a one ton of beam to two ton of load ratio.

The advantage of this invention is that it saves substantial manpower, as only one operator is needed at both ends of the loading procedure, instead of multiple workers. In addition, there are increased safety effects of not having workers with pole hooks trying to physically pull the load into the opening or under the structure. Finally, the crane operator does not have to make small adjustments in the vertical plane, thereby minimizing the risk of human error in the lifting procedure.

DETAILED DESCRIPTION OF THE PREFERRED EMBODIMENT

Figure 1:
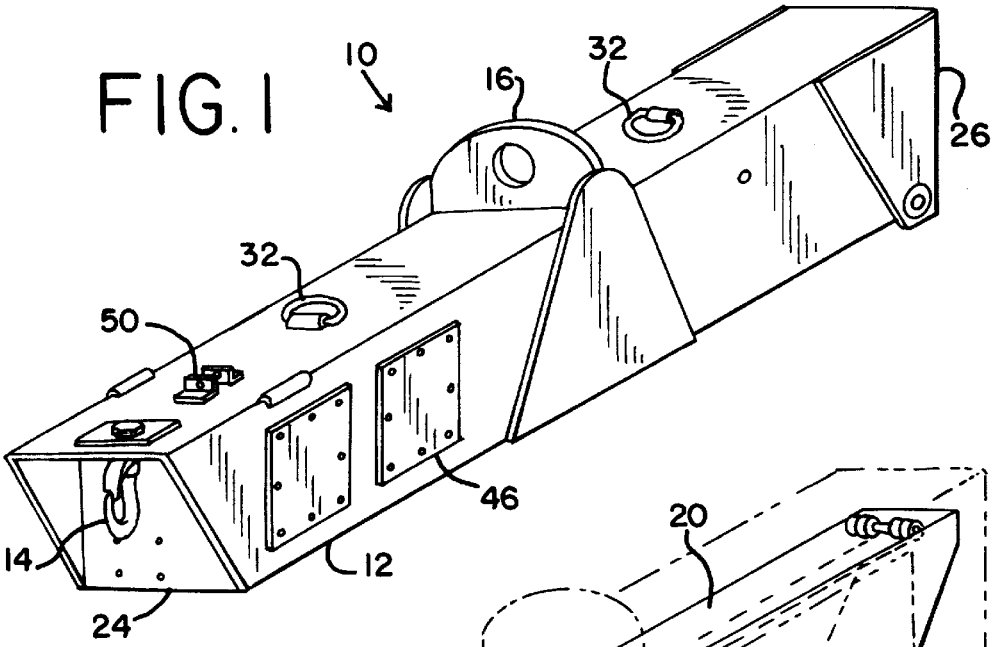
FIG. 1 is a perspective view of the preferred embodiment of the lifting beam.
Figure 2:
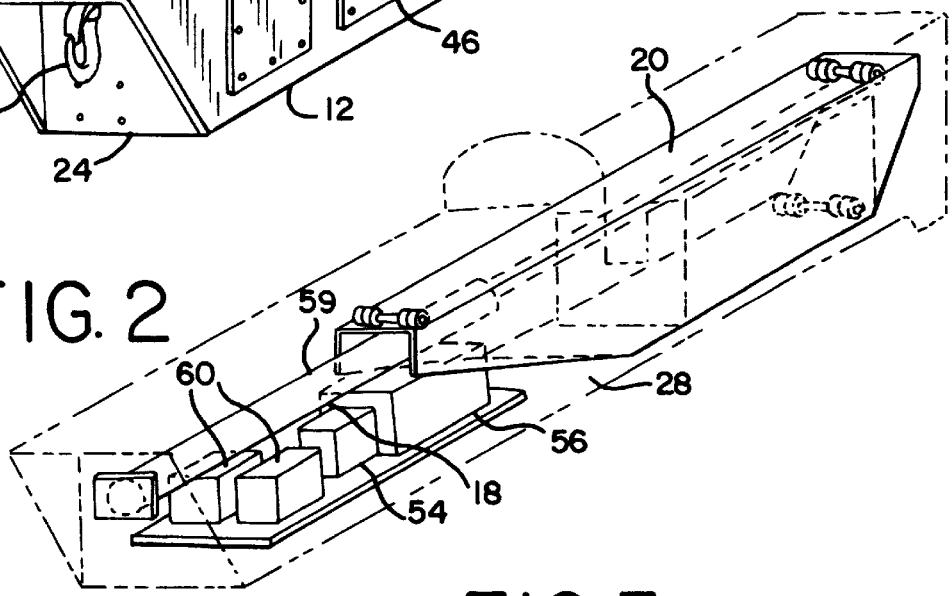
FIG. 2 is a perspective view in phantom of the lifting beam of FIG. 1, illustrating the relative relationship between the internal components of the lifting beam, particularly the hydraulic cylinder and the internal counterweight.

The present invention is directed to a lifting beam which is adapted to be connected to a crane and quickly and effectively self-level itself after a load has been attached at one end, allowing for quick and easy transportation of a load from the ground to a high-rise building under construction. The lifting beam, generally designated with the numeral 10, includes a housing member 12, a load securing member 14, a connector illustrated as an eyelet member 16, a hydraulic system 18 and a counterweight 20. The lifting beam 10 is designed to be connected to a boom or crane cable 22 of a crane.

The housing member 12, which includes a heavy gage steel housing welded to form a box beam, has a load receiving end 24 at one end thereof and a counterweight end 26 at the other end. The eyelet member 16 is weldably connected to the top of the housing member 12 along its vertical centerline. Although the aperture of the eyelet member 16 is shown in close proximity to the housing member 12, as best seen in FIG. 1, it is known to one of ordinary skill in the art that the length of the eyelet member 16 and the position of the eyelet member aperture can be extended outwardly from the housing member 12 along the lifting beam's vertical centerline to increase the stability of the lifting beam 10 as it is transported by a crane.

The load securing member 14, shown in the preferred embodiment as a swivel hook, is attached to the load end 24 of the housing member 12. A chamber 28 is defined within the housing member 12. The counterweight 20, which is connected to the hydraulic system 18, is slidably disposed within the chamber 28 and adapted to move axially in response to the change in the angular orientation of the housing member 12. Such movement can extend outside the counterweight end 26 of the housing member 12 a distance sufficient to balance the load.

Figure 3:
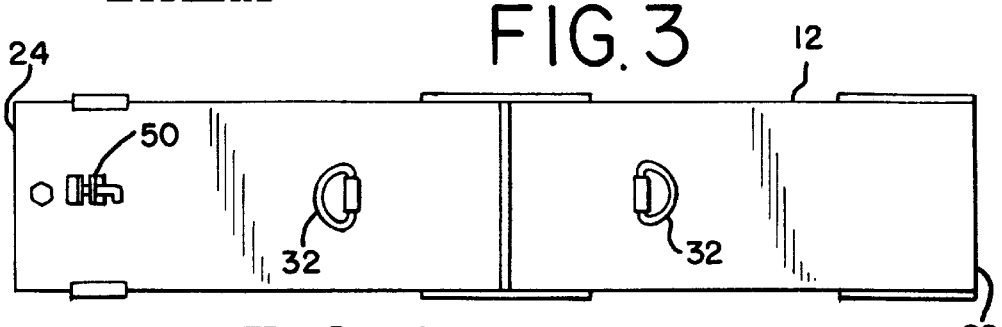
FIG. 3 is a top view of the lifting beam of FIG. 1 illustrating the preferred positions of the ring members, the chain wrap pin and the eyelet member.
Figure 4:
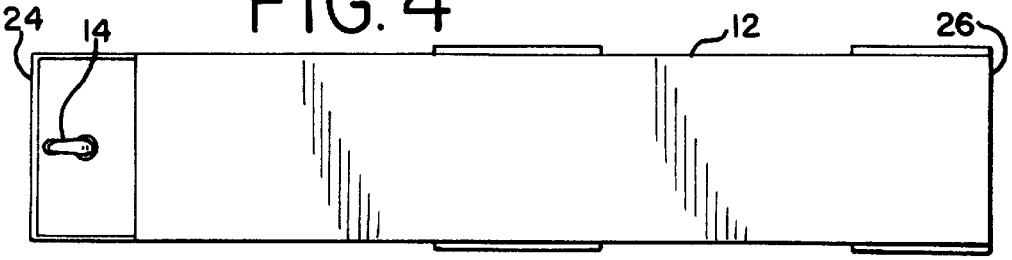
FIG. 4 is a bottom view of the lifting beam of FIG. 1.
Figure 5:
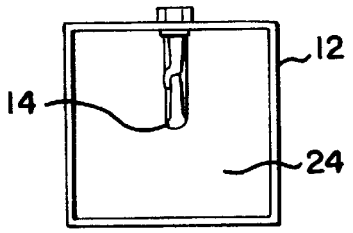
FIG. 5 is a left end view of the lifting beam of FIG. 1, illustrating the load securing means that is positioned at the load end of the lifting beam.
Figure 6:
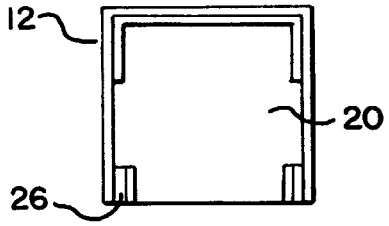
FIG. 6 is a right end view of the lifting beam of FIG. 1, illustrating the counterweight end of the lifting beam.
Figure 7:
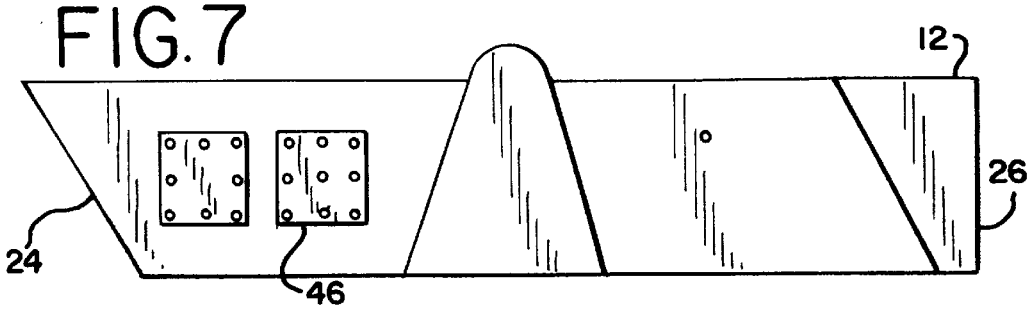
FIG. 7 is a front view of the lifting beam of FIG. 1, illustrating the location of the hydraulic access panel and external battery charger hookup.
Figure 8:
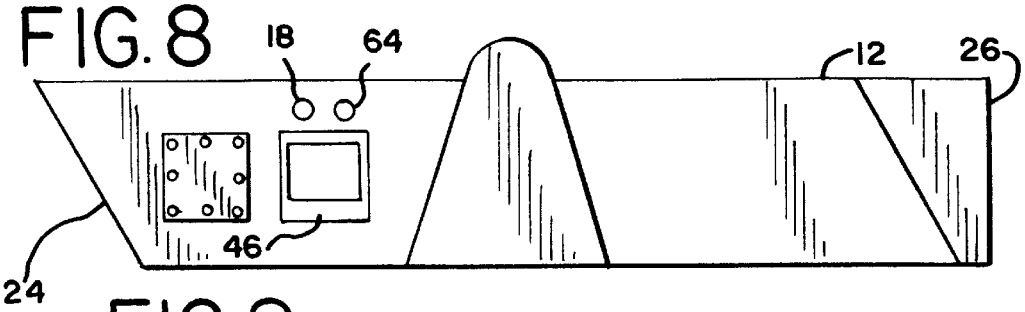
FIG. 8 is the same front view as depicted in FIG. 7, further illustrating the positioning of the electrical access panel and control cable storage door.
Figure 10:
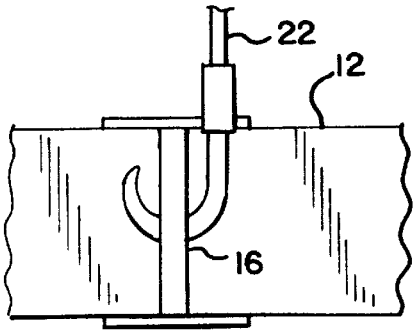
FIG. 10 is a top view of the lifting beam of FIG. 1 illustrating a crane cable attached to the eyelet member, causing a moment about the cable hook to the center of gravity of the lifting beam.

The preferred method of use involves a cooperative effort between the crane operator and the lifting beam operator. The housing member 12 of the lifting beam apparatus 10, is attached to a crane by means of a swivel hook, that is placed through the steel eyelet member 16, located on the vertical centerline of the housing member 12, as seen in FIG. 10. As shown in FIG. 3, two rings members 32 are welded to the top of the housing member 12 equidistant from the center eyelet member 16, allowing for the option of a split cable attachment, instead of a single cable attachment through the eyelet member 16 as shown in FIG. 10. Both attachment options provide the housing member 12 with a fulcrum about the crane cable 22.

Figure 16:
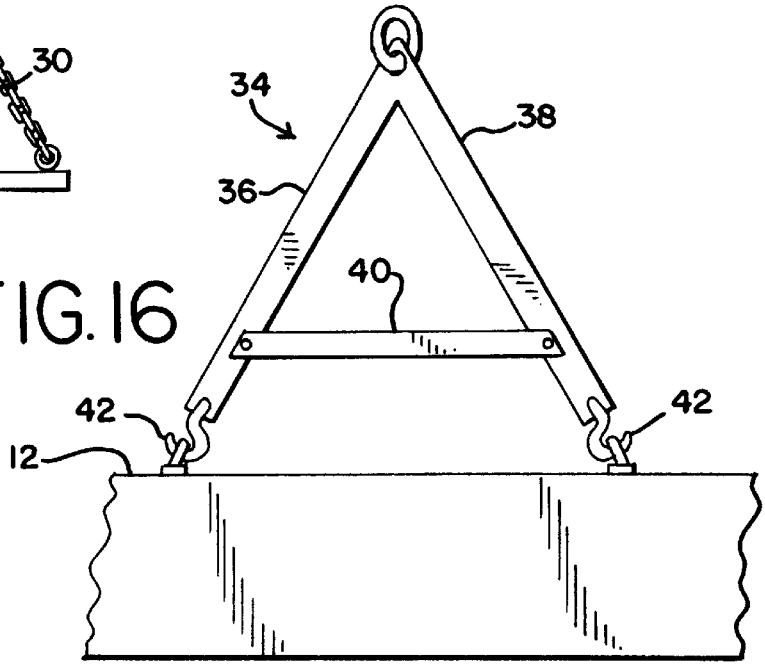
FIG. 16 is a front view of a stabilizer triangle used primarily for high wind insertion of loads where an insertion distance of less than three feet is acceptable.

The split cable attachment option is preferred for high wind insertion of loads where an insertion distance of less than three feet is acceptable. The preferred embodiment of this type of attachment is a stabilizer triangle apparatus 34, as shown in FIG. 16. The stabilizer triangle apparatus 34 includes three steel box beams 36, 38, 40 in the form of a triangle with hooks 42 at the ends of the beams 36 and 38 for attaching the apparatus 34 to the two ring members 32 of the housing member 12. This apparatus 34 reduces the amount of sway caused by wind that is normally associated with the transportation of the lifting beam apparatus when its is suspended by a single cable and a swivel hook.

Figure 11:
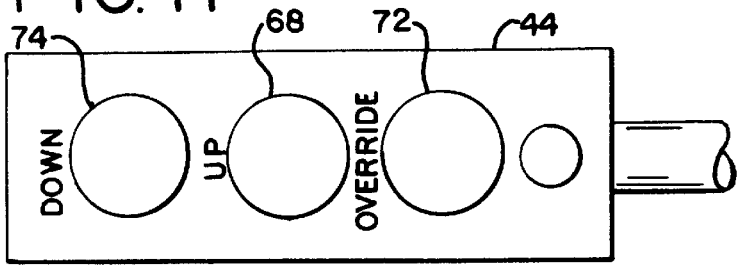
FIG. 11 is a front view of the face plate of the control box unit used to manually adjust and override the level sensing mechanism to eliminate the crane operator from having to make minor adjustments in the vertical plane.
Figure 12:
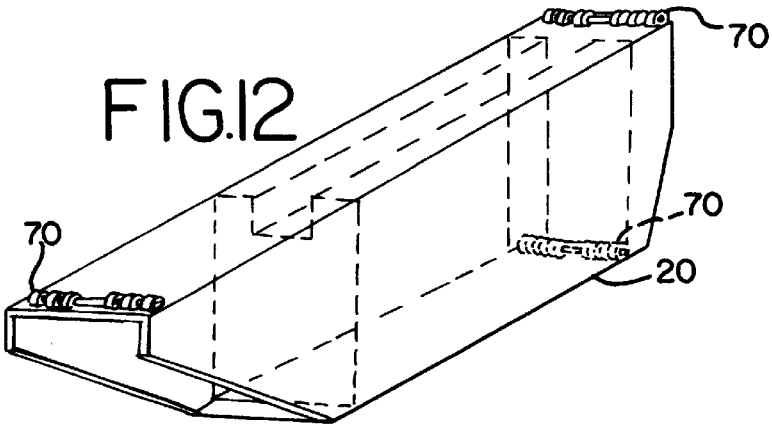
FIG. 12 is a perspective phantom view of the lifting beam apparatus of FIG. 1, illustrating the configuration of the counterweight and rollers, which provides the counterbalance for the load to oppose the moment caused by the distance between the eyelet member of the lifting beam and the load attachment.
Figure 14:
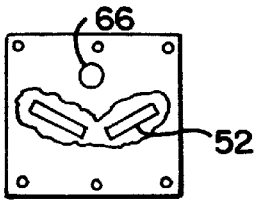
FIG. 14 is a cross-sectional view of the electrical access panel of FIG. 8, illustrating the automatic leveling limit switches and power warning light.
Figure 15:
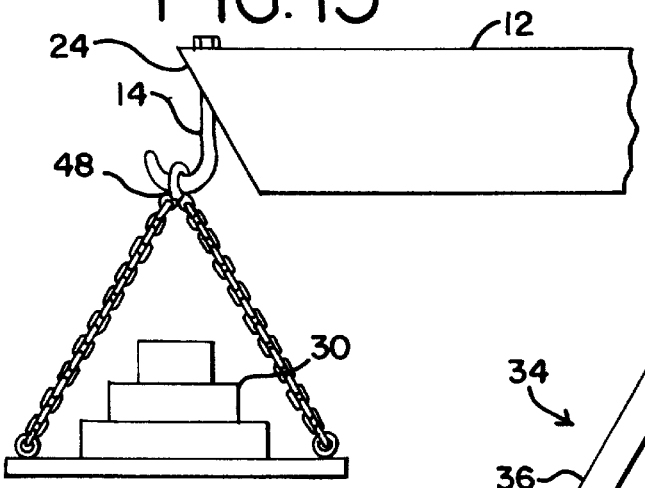
FIG. 15 is a front view of the load attached to the load securing member by the use of chains and a loading platform.

After the housing member 12 has been initially lifted off of the ground, the lifting beam operator removes the control cable unit 44, as seen in FIG. 11, from the beam cable door 46 and directs the crane operator to position the housing member 12 over the load 30. It is known that the load 30 can be attached to the housing member 12 in one of two ways. The preferred method, as shown in FIG. 15, is to have the load 30 chained or strapped to a steel ring 48 which in turn is hooked to the load securing member 14 at the load end 24 of the housing member 12.

The alternative method is to wrap a chain around the housing member 12, also at the load end 24, and utilize a pin 50 at the top of the housing member 12, as shown in FIG. 3, to insure the chain remains in place. The advantage of using the load securing member 14 to attach the load 30 to the load end 24 of the housing member 12 is that the load 30 can be rotated in the horizontal plane while the wrapped chain is fixed with only minimal movement in that plane.

Once the housing member 12 and the load 30 are attached to the crane, the crane picks up the housing member 12 by slowly raising the boom or crane cable 22, thereby allowing the automatic leveling limit switches 52 to adjust to the unbalanced load, as discussed in more detail below.

Figure 13:
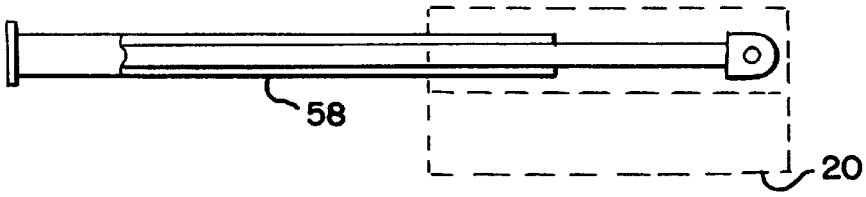
FIG. 13 is atop view of the hydraulic cylinder mechanism located between the load end of the lifting beam and the counterweight.

The preferred embodiment for positioning the counterweight is a hydraulic system 18. The hydraulic system 18 includes an eight gallon per minute hydraulic pump 54, powered by an internal DC electric motor, a three gallon reservoir 56 for storing hydraulic fluid, and an eleven foot hydraulic cylinder 58, best illustrated in FIG. 13. Although a hydraulic system 18 is shown, it is known that other similar type of arrangements for axially moving large masses can also be used, including, but not limited to, a rotary screw assembly, an electric solenoid type device, and other devices well known to those skilled in the art.

Figure 9:
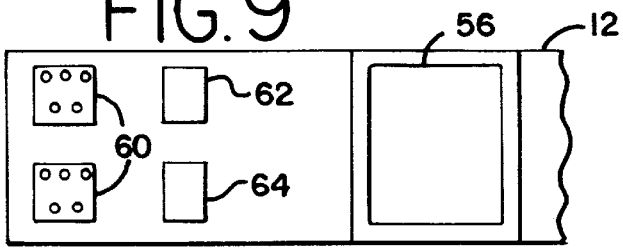
FIG. 9 is a cross-sectional view top view of the lifting beam of FIG. 1, illustrating the preferred positions of the internal hydraulic pump, storage batteries, reservoir and charger.

In response to an unbalanced load, the control cable unit 44 and the electric limit switches 52, which are mounted to be responsive to a five degree shift in the horizontal equilibrium of the housing member 12, operate to activate the hydraulic system 18, thereby causing movement of the counterweight 20. The power source for hydraulic system 18 consists of two heavy duty twelve volt storage batteries 60 connected in series. These batteries remain fully charged by the internal ten ampere charger 62, which is connected to a one hundred ten volt power source by the use of a female plug-in 64 on the outside of the housing member 12, as shown in FIG. 9. It should be noted that the electrical warning light 66 is "on" only when there is sufficient charge to operate the hydraulic system 18.

The beam operator uses the control cable unit 44 to initially level the housing member 12 by pressing the UP button 68, as shown in FIG. 11, which electrically activates the internal motor of the hydraulic pump 54, which in turn axially displaces the hydraulic cylinder 58. The counterweight 20, which is connected to the hydraulic cylinder 58, is equally displaced axially away from the load end 24 of the housing member 12 until the housing member 12 is once again horizontally level. The beam operator then places the control cable unit 44 back into the beam cable door 46.

With the load 30 attached to the load end 24 of the housing member 12, the housing member 12 and attached load 30 is further lifted by the crane operator to eventually be delivered to the desired location. The automatically leveling electric limit switches 52, automatically respond to any shifts in the equilibrium of the housing member 12 greater than five degrees. If the housing member 12 were to shift during transport by the crane operator, the electric limit switches 52 responds to these shifts by producing an electrical output that activates the internal motor of the hydraulic pump 54, which in turn axially displaces the hydraulic cylinder 58. The counterweight 20, which is connected to the hydraulic cylinder 58, is equally displaced axially until the housing member 12 is once again horizontally level. To ease in the axial displacement of the counterweight 20, a series of steel rollers 70 are provided along the inner walls of the housing member 12, to enable the counterweight 20 to move easily and not to impinge on the sides, top or bottom of the housing member 12.

Once the housing member 12 and attached load 30 reaches the desired location, the housing member 12 and attached load are usually inserted through an opening or under a structure as the need requires. The beam operator at the destination site then guides the load 30 into the opening. This can be done by utilizing the load securing member 14 on the load end 24 of the housing member 12 to rotate the load 30 or the swivel hook attached to the steel eyelet 16 of the housing member 12 to rotate both the housing member 12 and the load 30. Once the load 30 is properly in place, the beam operator removes the control cable unit 44 and pushes the OVERRIDE button 72 to override the automatic leveling switches 28. The beam operator then presses the DOWN button 74, thereby axially displacing the counterweight 20 towards the load end 24 of the housing member 12 until there is sufficient slack in the chain or other strap device to release the load securing member 14 from the load 30.

The manual override allows the beam operator to raise and lower the load 30 in the vertical direction without the necessity of the crane operator, who will be "blind" to the final positioning of the load 30, to make any adjustments in the vertical direction. After the load 30 is disconnected from the load end 24 of the housing member 12, the beam operator utilizes the control cable unit 44 to manually raise the load end 34 until the housing member 12 has sufficient clearance to be safely removed. The beam operator then places the control cable unit 44 in the beam cable door 46, and the crane operator backs out the housing member 12 from the destination site.

Removal of a load would be done in the opposite sequence as that shown and described for delivery of a load.

Various features of the invention have been particularly shown and described in connection with the illustrated embodiment of the invention. However, it must be understood that these particular arrangements merely illustrate, and that the invention is to be given its fullest interpretation within the terms of the appended claims.

We claim:

1. A self-leveling lifting beam adapted to facilitate depositing a load within or removing a load from an opening in a building with the aid of a cable, said lifting beam including:

a housing member defining an elongated beam having first and second lateral ends adapted to be connected to a load at one end thereof;

one or more connectors associated with said housing member and adapted to secure said housing member to the cable, thereby providing a fulcrum;

a load securing member mounted on said housing member positioned outwardly from said fulcrum, said load securing member adaptable for engaging and supporting the load;

a chamber defined within said housing member between said first and second lateral ends;

a counterweight normally slidably disposed within said chamber and movable along said lifting beam to extend outside of said chamber beyond one of said lateral ends;

a counterweight positioning mechanism associated with said counterweight to selectively move said counterweight so as to balance the load;

a level sensing mechanism associated with said housing member operative to sense when said housing member assumes an angular inclination which exceeds a predetermined value from horizontal equilibrium; and a control mechanism associated with said level sensing mechanism and said counterweight positioning mechanism, said control mechanism operative such that when said level sensing mechanism senses an angular inclination from horizontal beyond said predetermined value, said control mechanism activates said counterweight positioning mechanism to axially move said counterweight until the load is offset so as to maintain said housing member at horizontal equilibrium.

2. A self-leveling lifting beam in accordance with claim 1 wherein said control mechanism further includes an override feature such that, upon a signal from an operator, the level sensing mechanism is deactivated until a further signal is received.

3. A self-leveling lifting beam in accordance with claim 1 wherein said counterweight positioning mechanism includes a hydraulic pump and a cylinder connected to said counterweight.

4. A self-leveling lifting beam in accordance with claim 1 wherein said level sensing means includes electric limit switches.

5. A self-leveling lifting beam in accordance with claim 1 wherein said predetermined value is five degrees from horizontal equilibrium.

6. A self-leveling lifting beam in accordance with claim 1 further including a plurality of rollers associated with said counterweight and adapted to assist in the positioning of said counterweight.

7. A self-leveling lifting beam in accordance with claim 1 further including one or more internal storage batteries to provide power to said level sensing mechanism.

8. A self-leveling lifting beam in accordance with claim 1 further including one or more internal storage batteries to provide power to said counterweight positioning mechanism.

9. A self-leveling lifting beam in accordance with claims 7 or 8 further including a recharging apparatus for recharging said storage batteries.

10. A self-leveling lifting beam adapted to facilitate depositing a load within or removing a load from an opening in a building with the aid of a cable, said lifting beam including:

a housing member defining an elongated beam having first and second lateral ends adapted to be connected to a load at one end thereof;

connector means associated with said housing member to suspendingly support said housing member from the cable and thereby provide a fulcrum;

a load securing means mounted on said housing member positioned outwardly from said fulcrum, said load securing means adaptable for engaging and supporting the load;

a chamber defined within said housing member between said first and second lateral ends;

a counterweight normally slidably disposed within said chamber and movable horizontally along said lifting beam to extend outside of said chamber beyond one of said lateral ends;

counterweight positioning means associated with said counterweight to move said counterweight to vary the distance between the fulcrum and said counterweight, thereby offsetting the weight of the load so as to maintain said loaded beam in a horizontal position; and level sensing means operative to sense an unbalanced beam condition and when said imbalance exceeds a predetermined value, to activate said counterweight positioning means to move said counterweight until said lifting beam reaches a balanced condition.

11. A self-leveling lifting beam in accordance with claim 10 further including control means for activating said counterweight positioning means and overriding said level sensing means when the need arises to selectively tilt said housing member at an angle in the horizontal plane.

12. A self-leveling lifting beam in accordance with claim 10 wherein said counterweight positioning means includes a hydraulic pump and a cylinder connected to said counterweight.

13. A self-leveling lifting beam in accordance with claim 10 wherein said level sensing means includes electric limit switches.

14. A self-leveling lifting beam in accordance with claim 10 wherein said predetermined value is five degrees from horizontal equilibrium.

15. A self-leveling lifting beam apparatus in accordance with claim 10 including a plurality of rollers adapted to assist in the positioning of said counterweight.

16. A self-leveling lifting beam in accordance with claim 10 further including one or more internal storage batteries to provide power to said level sensing means.

17. A self-leveling lifting beam in accordance with claim 10 further including one or more internal storage batteries to provide power to said counterweight positioning means.

18. A self-leveling lifting beam in accordance with claims 16 or 17 further including means for recharging said storage batteries.

* * * * *